US006895921B1

(12) United States Patent
Girard

(10) Patent No.: US 6,895,921 B1
(45) Date of Patent: May 24, 2005

(54) EPICYCLIC CROSS PISTON INTERNAL COMBUSTION ENGINE

(76) Inventor: Peter Girard, 8001 Vista Dr., La Mesa, CA (US) 91941

( * ) Notice: Subject to any disclaimer, the term of this patent is extended or adjusted under 35 U.S.C. 154(b) by 0 days.

(21) Appl. No.: 10/632,946

(22) Filed: Aug. 1, 2003

(51) Int. Cl.[7] ..... F02B 75/32

(52) U.S. Cl. ..... 123/197.4; 123/54.1

(58) Field of Search ..... 123/197.4, 54.1, 123/54.2, 55.2, 55.4, 55.5, 55.6, 55.7

(56) References Cited

U.S. PATENT DOCUMENTS 5,189,994 A * 3/1993 Gindentuller ..... 123/197.4

* cited by examiner

*Primary Examiner*—Noah P. Kamen
(74) *Attorney, Agent, or Firm*—Charles C. Logan, II

(57) ABSTRACT

An epicyclic cross piston engine having a four, six or more cylinders. It has individual pairs of pistons rigidly connected together by connecting rods. The pistons travel axially in their respective cylinders for a complete reciprocal cycle. The cylinders are oriented at ninety degrees to each other. Connecting the respective rods together are a pair of crankshafts and a drive link that is connected to an output shaft. A substantially 360 rotation of said output shaft is produced by the complete reciprocal travel of each of the pistons in their respective cylinders.

4 Claims, 7 Drawing Sheets

EPICYCLIC CROSS PISTON INTERNAL COMBUSTION ENGINE

BACKGROUND OF THE INVENTION

The invention relates to an internal combustion engine and more specifically to one incorporating epicyclic sets of cross pistons.

It is a well known fact that a point on a circle rolling around the inside of another circle of twice its diameter, without slippage, will travel forward and backward along a straight line; a diameter of the larger circle.

Piston designers of the past have often been intrigued with this relationship and some have attempted to utilize it in attempts to approve the design of engines as it holds the promise of simplifying the piston/connecting-rod/crankshaft relationship. Engines employing conventional gears to achieve this action have been constructed, but none have been produced in quantity, due apparently to problems involving the gearing.

Some prior art internal combustion engines will be discussed below.

The Llewellyn U.S. Pat. No. 3,329,134 is directed to a small sized gasoline powered engine. The objects of the invention are to provide an engine with a greatly reduced number of working parts, to provide an arrangement of the parts which will simplify and compact the engine so that it is especially suitable for use on power mowers, chain saws and the like and to reduce the torsion imposed upon the crankshaft and the stress placed on other engine parts to a point where lightweight and relatively inexpensive components may be used. The crankshaft is journaled in the pistons rather than in the crankcase as in a conventional engine. This eliminates the use of connecting rods and results in an unusual crankshaft motion from which mechanical advantage is derived.

The Paillier U.S. Pat. No. 3,946,706 is directed to a rotary engine comprising four cylinders in a star cluster. It has a first assembly of two pistons suitable to slide in two of the cylinders connected together head to tail by a first rigid cross piece. It also has a second assembly of two pistons suitable to slide in the other two cylinders and connected together head to tail by a second rigid cross piece. It also has a mechanism with eccentrics suitable to transform the alternating sliding of these two assemblies into rotation of the shaft.

The Wrin U.S. Pat. No. 4,026,252 is directed to a two-cycle engine having a pair of pistons mounted within a pair of cylinders which are arranged in an oppositely facing in-line manner. It has separate connecting rods for each of the pistons that are mounted on a crankshaft that is rotatably mounted with respect to a planetary gear carrier.

The Stiller et al U.S. Pat. No. 5,046,459 is directed to an engine having two pairs of pistons each pair are connected to each other by a rigid connecting rod. A trammel gear is connected to a first connecting rod through a first pivot pin. The trammel gear is also connected to a second connecting rod through a second pivot pin. By movement of the various pistons in a predetermined sequence, the trammel gear will be caused to rotate and thereby convert the transnational movement of the connecting rods into responsive rotary and translator movement of the trammel gear.

The Puzio U.S. Pat. No. 5,228,416 is directed to an internal combustion engine utilizing a disc-shaped crankshaft operatively connected with respect to at least one pair of opposed pistons. Each piston of each pair is fixedly secured with respect to a shaft extending therebetween. With two pairs of pistons they are arranged at right angles with respect to one another such that each piston fires controlled by a timing device to maintain the rotary crankshaft. The crankshaft can include a gear device or a friction surface device about the external periphery thereof to facilitate distribution of power therefrom. The crankshaft defines an aperture therein within which a crankpin is positioned with an off set connecting arm extending in each opposite direction. The offset connecting arm extends into a bore within which is positioned the rod extending to each pair of pistons. The path of movement of the crankpin is circular to receive driving force of the pistons at selectively timed intervals.

The Bracket U.S. Pat. No. 5,259,256 is directed to a device for translating rotary to linear motion and vice-versa and it includes a reciprocating linearly moving shuttle with a central aperture. The aperture has a pair of opposing gear racks protruding towards the center which capture therebetween a pair of pinion sectors rotatably mounted to the crankpin of a rotatable crankshaft with the axis of the crankshaft rotation perpendicular to the linear path of the shuttle. The pinon sectors are free to rotate about the crankpin and articulate independently of each other through a selected angular range.

The Vaux et al U.S. Pat. No. 5,331,926 is directed to an internal combustion engine utilizing a dwelling scotch yoke and a journaled flywheel and a unique combination for stalling the translator movement of an oppositively paired pistons during the detonation of the fuel mixture to achieve a clear exhaust and an energy efficient engine.

SUMMARY OF THE INVENTION

It is a well known fact that a point on a circle rolling around the inside of another circle of twice its diameter, without slippage, will travel forward and backward along a straight line that is also the diameter of the larger circle. This principal has been utilized in the epicyclic cross piston internal combustion engine that has been designed.

The salient features of the system described herein are as follows:

1) it has a reciprocating engine (Otto or Diesel cycle) employing essentially conventional cylindrical pistons and utilizing the above noted epicyclic principle without recourse to the use of gears, cams, link belts or other type of belts in the main drive train. The engine may utilize four, six or more cylinders.

2) transmission of power to the output shaft is by means of a very short crankshaft incorporating, in the case of a four cylinder engine, a single throw. The cylinders are not arranged radially around a single throw crankshaft in the manner of a conventional aircraft radial engine.

3) because of the epicyclic features, conventional piston/crankshaft connecting rods with wrist pins are not required; the connecting rods are rigidly attached to the pistons.

4) cylinders are nested in such a manner that a four cylinder engine would only be approximately ⅓ the length of a conventional in-line engine.

5) it possesses fewer parts than a conventional engine due to its compact configuration, it doesn't need conventional connecting rods and it has a short single throw crankshaft as well as other features made possible by the epicyclic feature.

6) there is a lower cost of manufacturing due to the above features as well as the fact that a fewer number of parts are needed.

7) the engine would usually be somewhat lighter than a conventional engine of comparable power.

8) although the concept appears to offer no thermodynamic advantage relative to efficiency, it does appear to offer greater mechanical efficiency. This is due to the fact that piston/cylinder wall scrubbing drag is greatly reduced as there is no lateral component of force of the connecting rod forcing the piston against the cylinder wall as in the case for the conventional piston engine whose connecting rod becomes angled relative to the center line of the cylinder during both the intake and power strokes. In this later case, the angles become rather large as the piston departs from the top dead center (TDC) and the (BDC) positions. This condition occurs on both the power and exhaust strokes. Since the connecting rod of the subject engine concept is always aligned with the axis of the cylinder, this condition is not present.

DESCRIPTION OF THE PREFERRED EMBODIMENT

Figure 1:
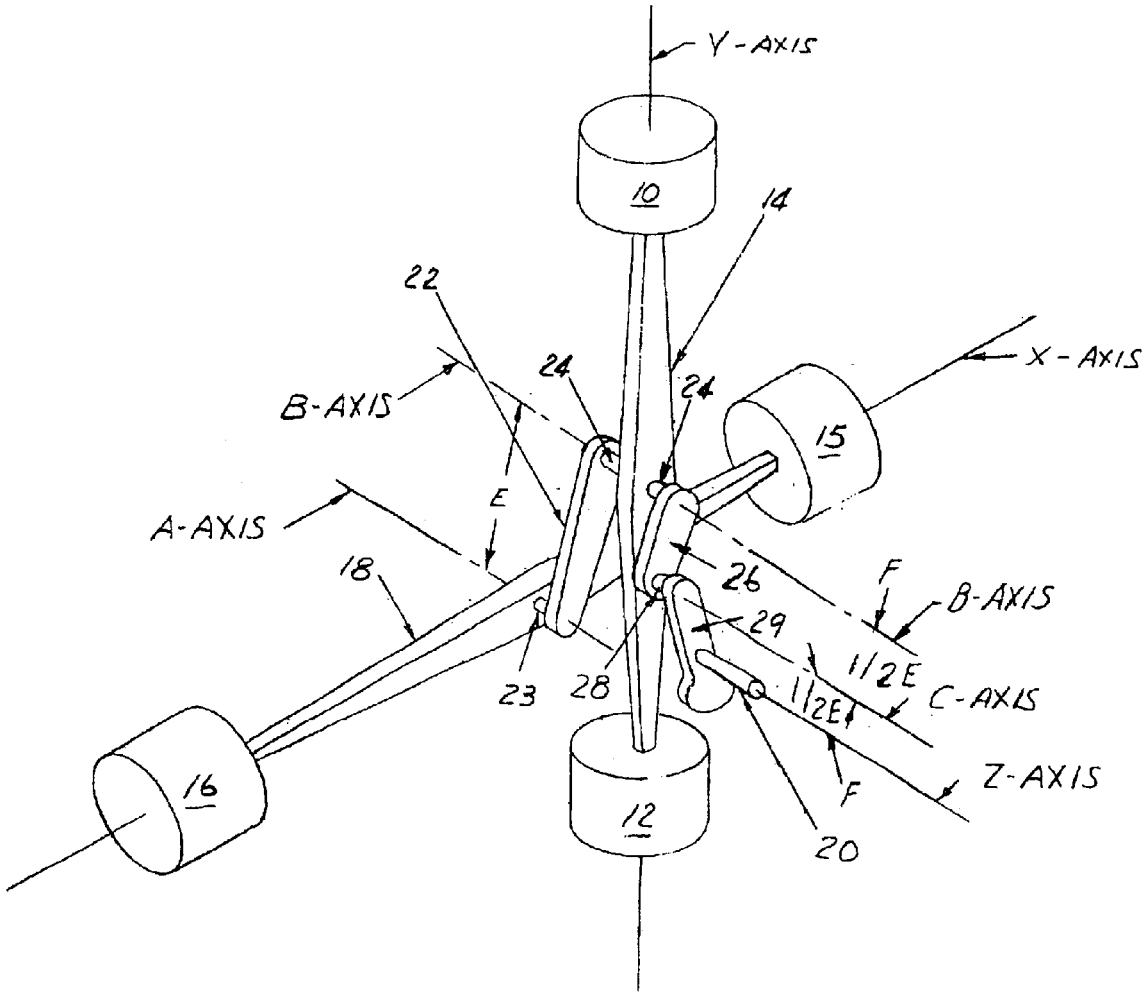
FIG. 1 is a schematic perspective view illustrating how the axial travel of the pistons is transmitted into a rotational movement for the output shaft.

The epicyclic cross piston engine will now be described by referring to FIGS. 1–7 of the drawings. FIG. 1 is a schematic front perspective view that clearly explains the basic principles of the engine. A piston 10 and a piston 12 are rigidly connected to the opposite ends of a master connecting rod 14. The master connecting rod has a longitudinally extending Y-axis The respective pistons would move upwardly and downwardly in their own separate cylinders (not shown). Another pair of pistons 15 and 16 are rigidly connected to the opposite ends of secondary connecting rod 18. Secondary connecting rod 18 has a longitudinally extending X-axis that is laterally offset from the Y-axis. A vertical plane passing through the Y-axis and horizontal plane passing through the X-axis would intersect each other at a ninety degree angle. Pistons 15 and 16 would travel reciprocally back and forth in their own separate cylinders (not shown). The reciprocal motion of the respective connecting rods produces a rotational motion of the output shaft 20 that has a Z-axis that is perpendicular to the X-axis and the Y-axis.

A bellcrank coordinating arm 22 has a pin 23 rigidly secured thereto and it has an axial A-axis that is parallel to the Z-axis. Pin 23 is journaled in a bore hole passing transversely through the midpoint of connecting rod 18. A pin 24 has an axial B-axis that is parallel to the A-axis and they are separated by a distance E. One end of pin 24 is rigidly secured to bellcrank coordinating arm 22 and its opposite end is rigidly connected to bellcrank output arm 26. Pin 24 is journaled in the midpoint position of connecting rod 14. A pin 28 has an axial C-axis whose one end is journaled in a bore hole in bellcrank output arm 26. The other end of pin 28 is rigidly secured to driveshaft link 29. The C-axis and B-axis are parallel to each other and they are spaced apart a distance F. Output shaft 20 has its rear end rigidly secured to drivelink 29. The distance F is equal to ½ E. When combustion takes place in its proper sequence in the respective cylinders, connecting rod 18 will travel horizontally along the X-axis and connecting rod 14 will travel vertically along the Y-axis and the combination of these two motions will produce a rotational travel output on the output shaft 20 that has a Z-axis.

Figure 2:
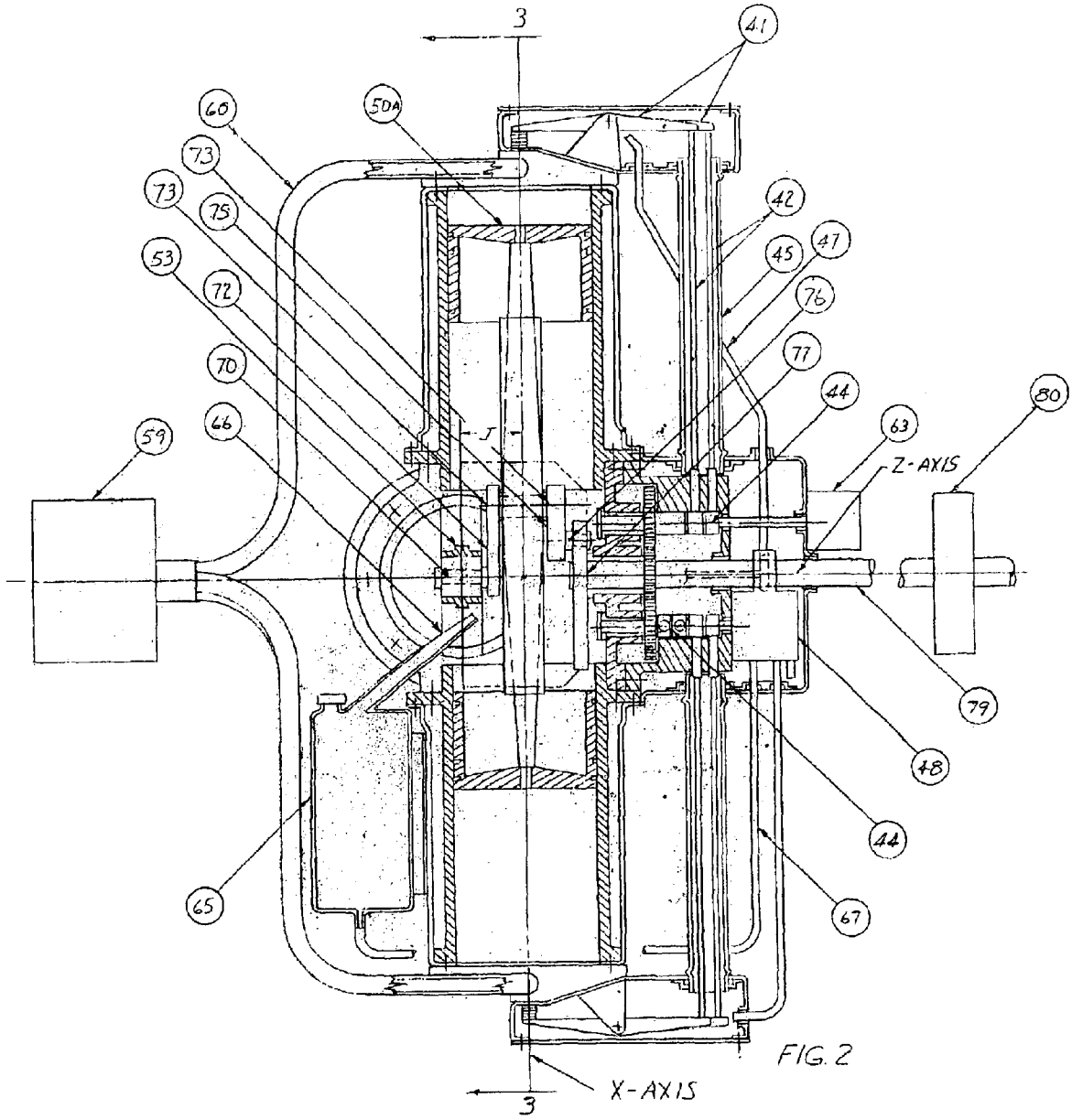
FIG. 2 is a schematic side elevation view of the four cycle epicyclic cross piston engine.
Figure 3:
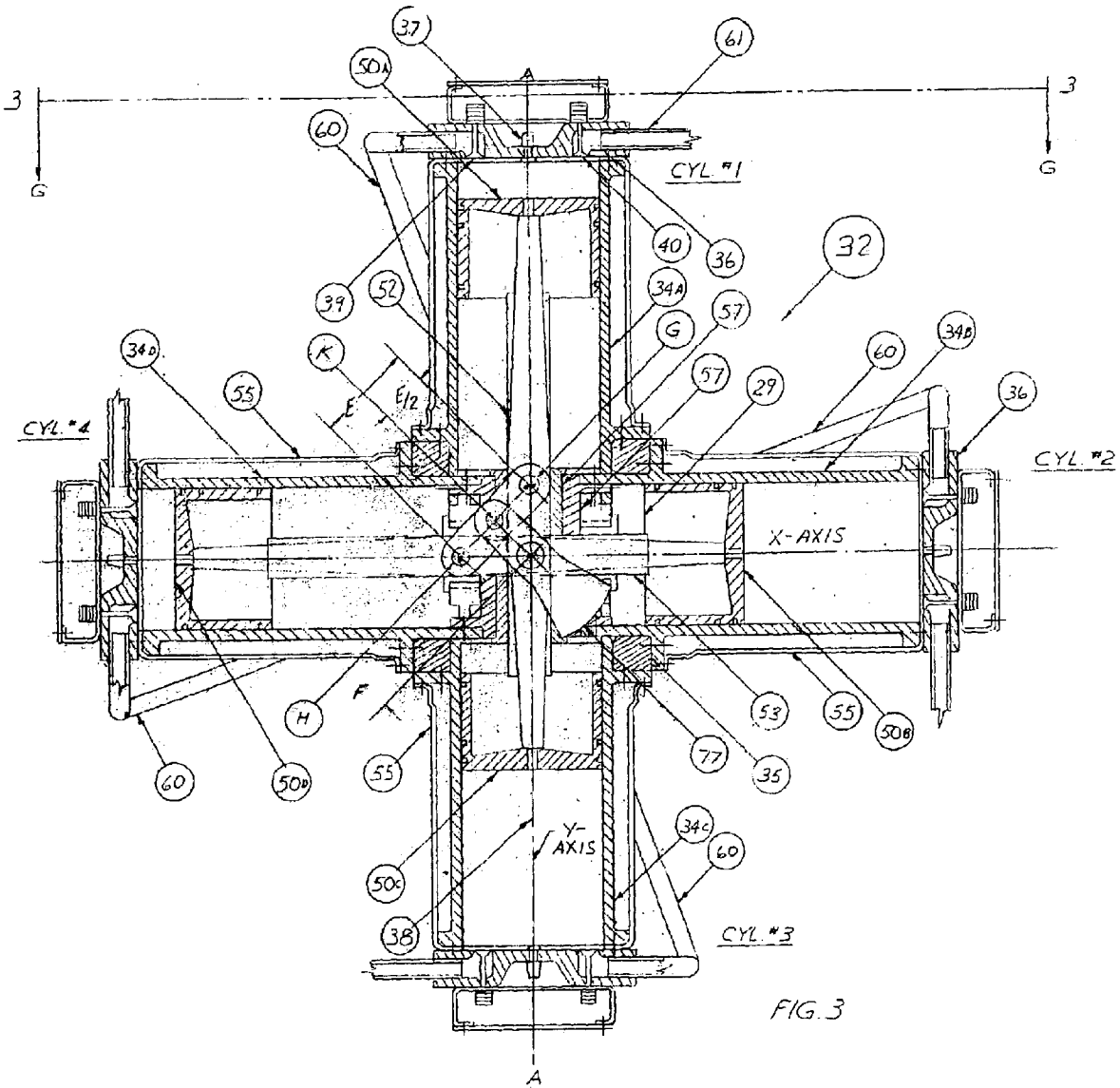
FIG. 3 is a cross sectional view taken along lines 3—3 of FIG. 2.
Figure 4:
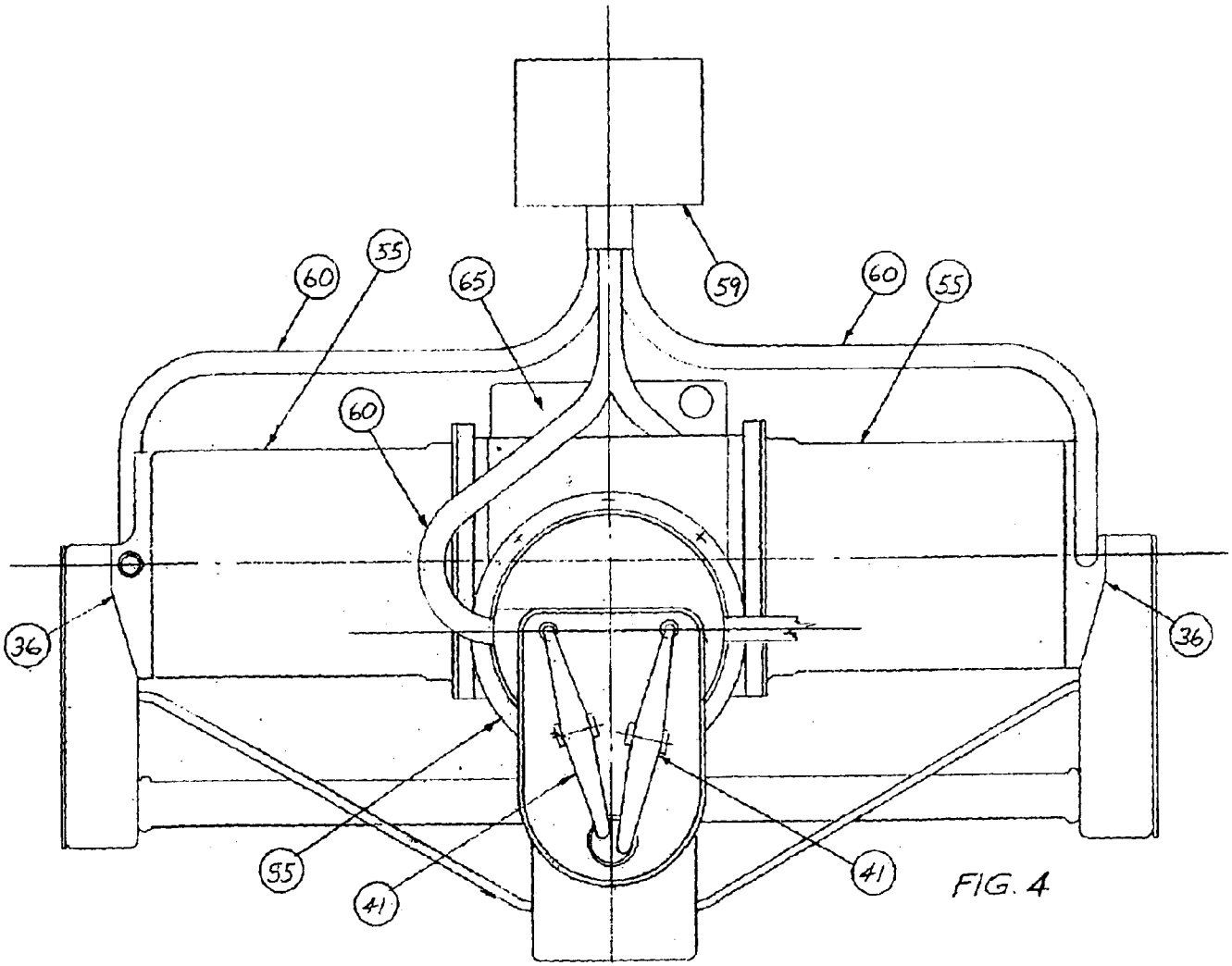
FIG. 4 is a schematic top plan view of the four cycle epicyclic cross piston engine.

A four cylinder epicyclic cross piston engine is illustrated in FIGS. 2–4. The engine is generally designated numeral 32. It has four cylinders, 34*a*, 34*b*, 34*c*, and 34*d* whose bottom ends are each secured in a crankcase 35. Each cylinder has a cylinder head 36 and a sparkplug 37 that extends into the compression chamber 38. An intake valve 39 and an exhaust valve 40 are reciprocally mounted in cylinder head 36. The respective valves are opened and closed by valve rocker arms 41 that are pushed upwardly by push rods 42 that are lifted upwardly by valve cams 44 as they rotate. The push rods 42 are surrounded by a housing 45. Lubrication is provided to the rocker arms by rocker arm lubrication tube 47 that is connected to oil pump 48.

The rear end of pistons 50*a* and 50*c* are rigidly connected to the opposite ends of master connecting rod 52. The rear ends of cylinders 50*b* and 50*d* are rigidly connected to the opposite ends of secondary connecting rod 53. The respective cylinders are surrounded by a coolant jacket 55. Lateral movement of the respective connecting rods as they travel through their reciprocal motion is stabilized by connecting rod lateral support slippers 57.

Fuel is supplied to the respective cylinders by a distributor 59 through the intake manifold 60. An exhaust manifold 61 is connected to each of the exhaust valves 40. Ignition is provided to each combustion chamber 38 by a distributor 63. Oil tank 65 is connected to an oil scavenging pickup 66 and also to the oil return line 67 that connects to oil pump 48.

Looking to FIG. 2, cylinder 50*d* is shown removed for clarity. The X-axis of secondary connecting rod 53 is shown laterally spaced behind master connecting rod 52 by a distance J. The rear end of pin 70 is journaled in a bore hole in secondary connecting rod 53. The front end of pin 70 is rigidly secured to the bottom end of bellcrank coordinating arm 72 and pin 70 has an A-axis. A pin 73 having a B-axis has its rear end rigidly secured to the top end of bellcrank coordinating arm 72. The intermediate portion of pin 73 is journaled in a bore hole in master connecting rod 52. The distance between A-axis and B-axis is E. A bellcrank output arm 75 has its top end rigidly secured to the front end of pin 73. The bottom end of bellcrank output arm 75 has a pin 76 rigidly secured thereto and it has a C-axis. The distance between C-axis and B-axis is a distance F and F is equal to ½ E. The front end of pin 76 is journaled in a bore hole in drive shaft link 77. Drive shaft link 77 is rigidly secured to the rear end of output shaft 79 which has a Z-axis. A flywheel 80 would be secured forwardly on output shaft 79.

During operation, points H and G are restrained to travel only along the X-axis and the Y-axis respectfully by the rigid nature of the connecting rods joining them. Their action is coordinated by bellcrank coordinating arm 72 and in so doing, point K travels in a circular path around the Z-axis when the distance F on the driveshaft link 77 is one half of the distance E on the bellcrank coordinating arm 72.

Figure 5:
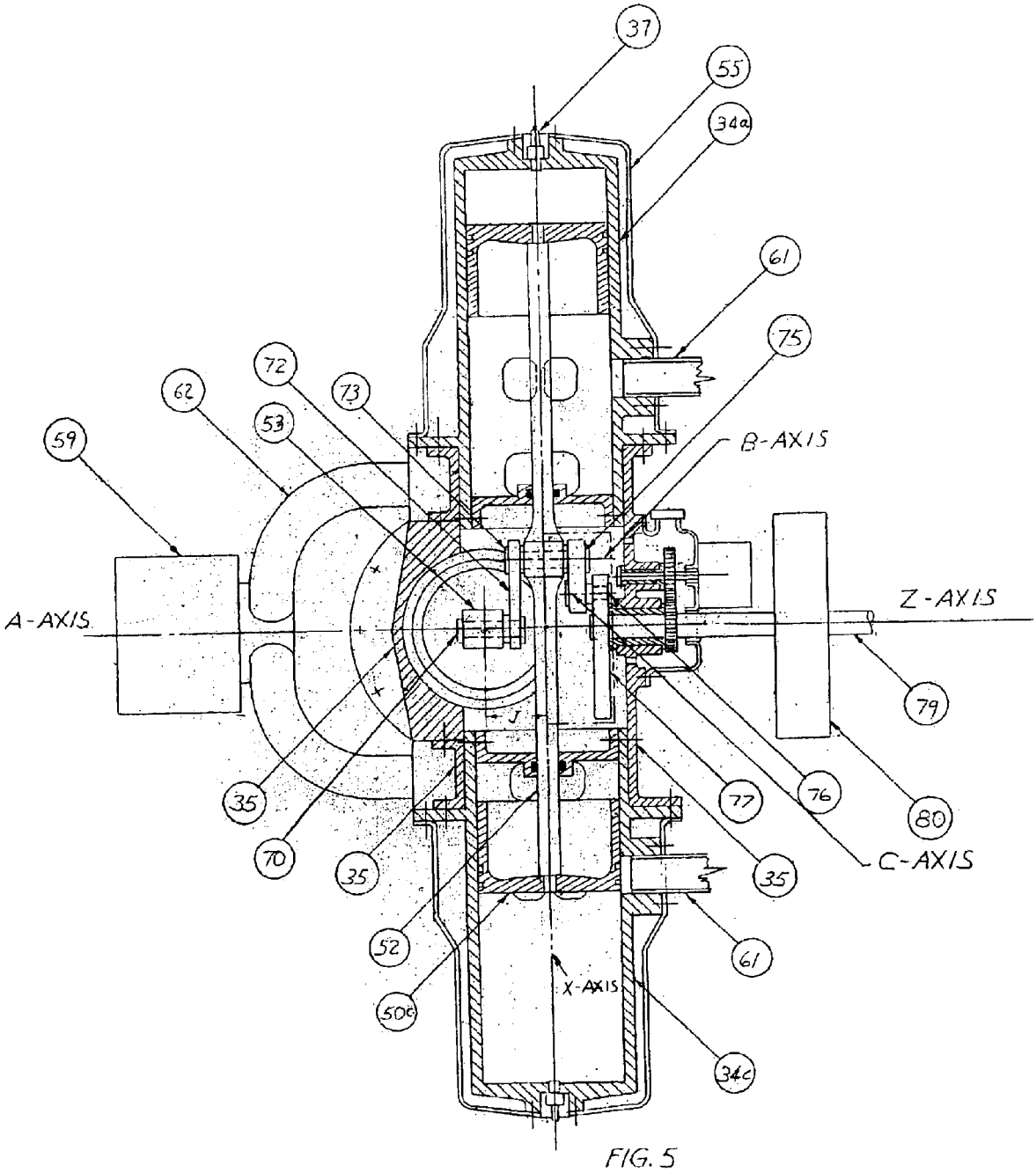
FIG. 5 is a schematic horizontal cross sectional view of a two cycle epicyclic cross piston engine.
Figure 6:
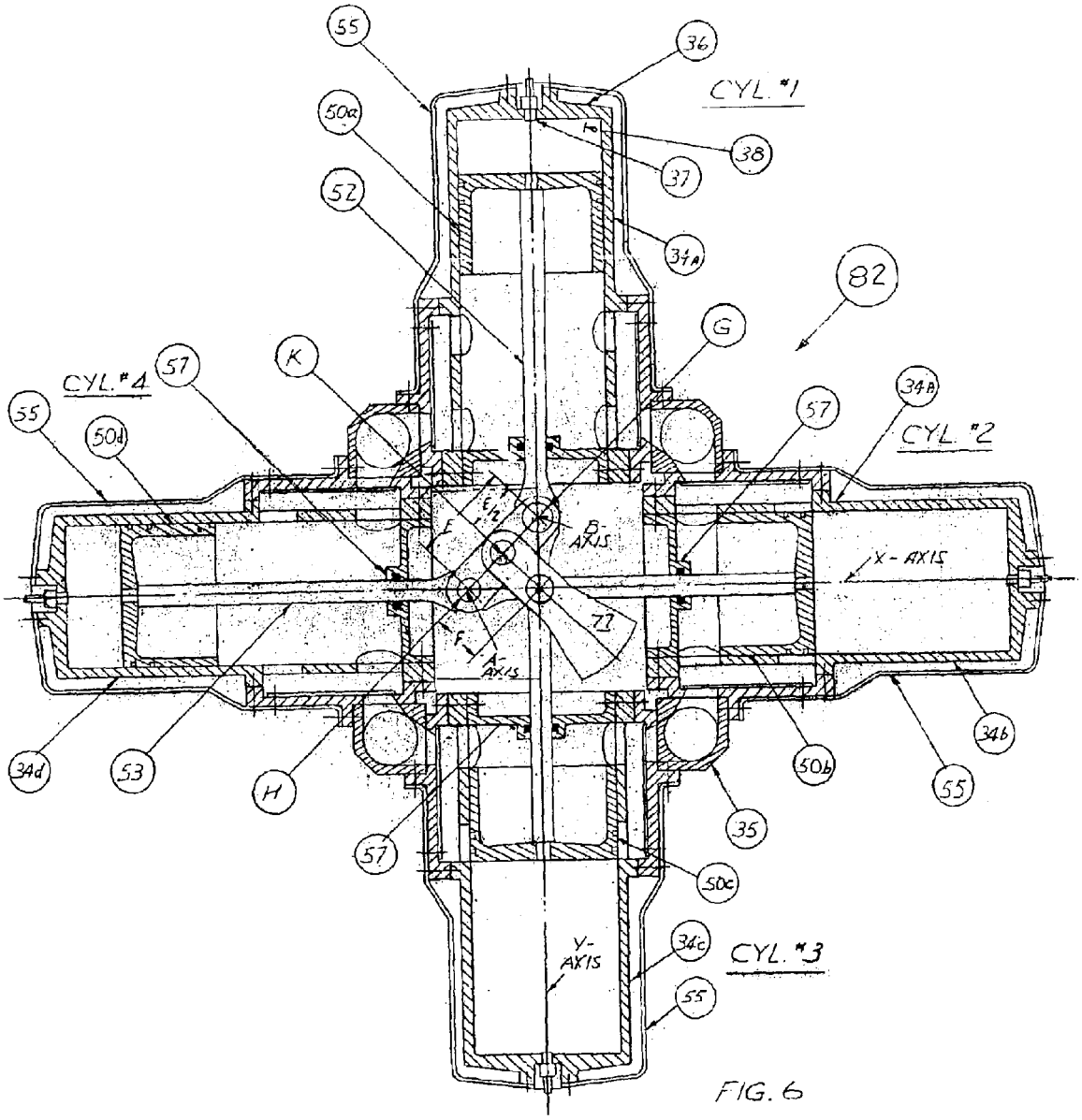
FIG. 6 is a cross sectional view taken along lines 6–5 of FIG. 5.
Figure 7:
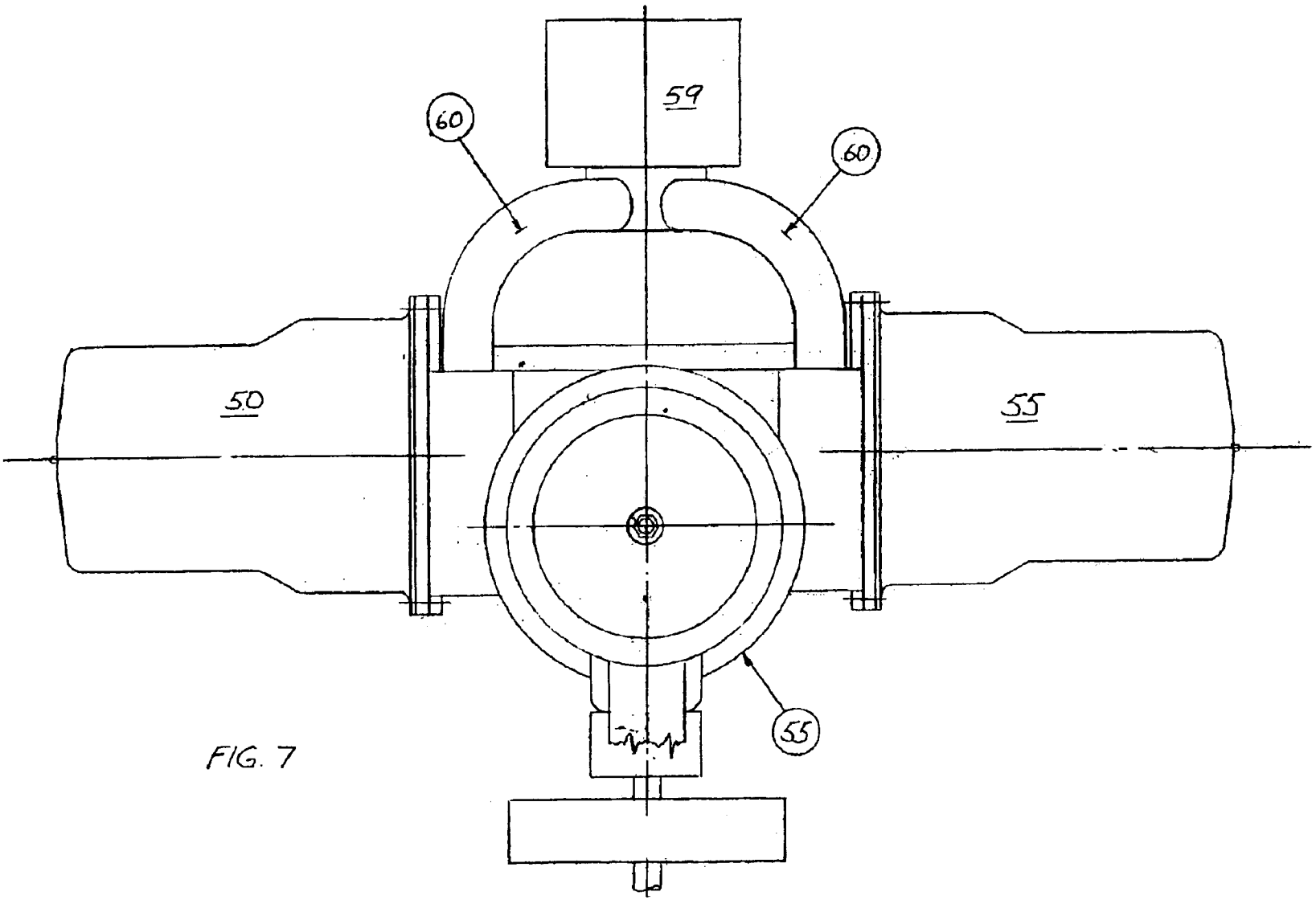
FIG. 7 is a schematic top plan view of the two cycle epicyclic cross piston engine.

A two cycle epicyclic cross piston engine is illustrated in FIGS. 5–7. The engine is generally designated numeral 82. Similar structure in the two cycle engine 82 is given the same identification numbers as those set forth in the four cycle epicyclic cross piston engine 32.

Two cycle engine 82 has four cylinders, 34*a*, 34*b*, 34*c*, and 34*d* whose bottom ends are each secured in a crankcase 35. Each cylinder has a cylinder head 36 and a sparkplug 37 that extends into the compression chamber 38.

The rear end of pistons 50*a* and 50*c* are rigidly connected to the opposite ends of master connecting rod 52. The rear ends of cylinders 50*b* and 50*d* are rigidly connected to the opposite ends of secondary connecting rod 53. The respective cylinders are surrounded by a coolant jacket 55. Lateral movement of the respective connecting rods as they travel through their reciprocal motion is stabilized by connecting rod lateral support slippers 57.

Fuel is supplied to the respective cylinders by a distributor 59 through the intake manifold. An exhaust manifold is connected to each of the exhaust valves. Ignition is provided to each combustion chamber 38 by a distributor.

Looking to FIG. 5, cylinder 50*d* is shown removed for clarity. The X-axis of secondary connecting rod 53 is shown laterally spaced behind master connecting rod 52 by a distance J. The rear end of pin 70 is journaled in a bore hole in secondary connecting rod 53. The front end of pin 70 is rigidly secured to the bottom end of bellcrank coordinating arm 72 and pin 70 has an A-axis. A pin 73 having a B-axis has its rear end rigidly secured to the top end of bellcrank coordinating arm 72. The intermediate portion of pin 73 is journaled in a bore hole in master connecting rod 52. The distance between A-axis and B-axis is E. A bellcrank output arm 75 has its top end rigidly secured to the front end of pin 73. The bottom end of bellcrank output arm 75 has a pin 76 rigidly secured thereto and it has a C-axis. The distance between C-axis and B-axis is a distance F and F is equal to ½ E. The front end of pin 76 is journaled in a bore hole in drive shaft link 77. Drive shaft link 77 is rigidly secured to the rear end of output shaft 79 which has a Z-axis. A flywheel 80 would be secured forwardly on output shaft 79.

What is claimed:

1. An epicyclic cross piston engine comprising:

a #1 cylinder, a #2 cylinder, a #3 cylinder and a #4 cylinder and they each have a cylindrical bore;

a #1 cylindrical piston, a #2 cylindrical piston, a #3 cylindrical piston and a #4 cylindrical piston and they each have a top surface and a bottom end;

an elongated master connecting rod having a top end, a bottom end and a longitudinally extending Y-axis; said master connecting rod having a mid-point having a transversely extending #2 bore hole;

first connection means rigidly connecting said top end of said master connecting rod to said bottom end of said #1 cylindrical piston; said #1 cylindrical piston being telescopically received in said bottom end of said #1 cylinder for reciprocal travel;

second connection means rigidly connecting said bottom end of said master connecting rod to said bottom end of said #3 cylindrical piston; said #3 cylindrical piston being telescopically received in said bottom end of said #3 cylinder for reciprocal travel;

an elongated secondary connecting rod having a front end, a rear end and a longitudinally extending X-axis; said secondary connecting rod having a transversely extending #1 bore hole;

third connecting means rigidly connecting said top end of said secondary connecting rod to said bottom end of said #2 cylindrical piston; said #2 cylindrical piston being telescopically received in said bottom end of said #2 cylinder for reciprocal travel;

fourth connection means rigidly connecting said bottom end of said secondary connecting rod to said bottom end of said #4 cylindrical piston; said #4 cylindrical piston being telescopically received in said bottom end of said #4 cylinder for reciprocal travel;

an elongated output shaft having a front end, a rear end and a longitudinally extending Z-axis;

said Z-axis is oriented perpendicular to both said X-axis and said Y-axis; said X-axis and said Y-axis lie in separate parallel planes perpendicular to said Z-axis and said separate parallel planes are longitudinally spaced from each other a predetermined distance J along said Z-axis; said X-axis and said Y-axis are oriented substantially ninety degrees to each other when looking along said Z-axis;

drive train means connecting said master connecting rod and said secondary connecting rod to said output shaft that produces 360 degree rotation in said output shaft as a result of a complete reciprocal travel cycle of each of said pistons in their respective cylinders;

said drive train means comprising:

an elongated bellcrank coordinating arm having a front end, a rear end, a rear surface and a front surface;

an elongated bellcrank output arm having a front end, a rear end, a rear surface and a front surface; a #3 bore hole is formed in said bellcrank output arm adjacent said rear end of said bellcrank output arm;

an elongated driveshaft link having a front end, a rear end, a rear surface and a front surface;

a #1 pin having a front end, a rear end and a longitudinally extending A-axis; said rear end being journaled in said #1 bore hole of said secondary connecting rod; said front end of said #1 pin being rigidly connected to said rear surface of said bellcrank coordinating arm adjacent said rear end of said bellcrank coordinating arm;

a #2 pin having a front end, a rear end and a longitudinally extending B-axis; said #2 pin being journaled in said #2 bore hole of said master connecting rod; said rear end of said #2 pin being rigidly connected to said front surface of said bellcrank coordinating arm adjacent said top end of said bellcrank coordinating arm; said front end of said #2 pin being rigidly connected to said rear surface of said bellcrank output arm adjacent said front end of said bellcrank output arm;

a #3 pin having a front end, a rear end and a longitudinally extending C-axis; said rear end of said #3 pin is journaled in said #3 bore hole in said bellcrank output arm; said front end of said #3 pin is rigidly connected to said rear surface of said driveshaft link adjacent said front end of said driveshaft link; and said rear end of said output shaft is rigidly connected to said front surface of said driveshaft links.

2. An epicyclic cross piston engine as recited in claim 1 wherein said B-axis is parallel to said A-axis and said B-axis is located a predetermined distance E from said A-axis.

3. An epicyclic cross piston engine as recited in claim 2 wherein said C-axis is parallel to said B-axis and said distance between said B-axis and said C-axis is ½ E.

4. An epicyclic cross piston engine as recited in claim 3 wherein the distance between said C-axis and said B-axis is F and F is equal to ½ E.

* * * * *